US006952541B2

(12) United States Patent
Fujimori et al.

(10) Patent No.: US 6,952,541 B2
(45) Date of Patent: Oct. 4, 2005

(54) FIXING APPARATUS

(75) Inventors: Takashi Fujimori, Ibaraki (JP); Eiichi Motoyama, Tokyo (JP); Hidenori Sunada, Ibaraki (JP); Takahiko Yamaoka, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/673,502

(22) Filed: Sep. 30, 2003

(65) Prior Publication Data

US 2004/0126127 A1 Jul. 1, 2004

(30) Foreign Application Priority Data

Oct. 2, 2002 (JP) ..... 2002-289681

(51) Int. Cl.[7] ..... G03G 15/20
(52) U.S. Cl. ..... 399/70; 219/216; 399/69
(58) Field of Search ..... 399/69, 70, 67, 399/328, 320, 43; 347/156; 219/216, 619, 494

(56) References Cited

U.S. PATENT DOCUMENTS 5,987,275 A * 11/1999 Toyohara et al. ..... 399/70
6,101,346 A * 8/2000 Arakawa ..... 399/70
6,263,172 B1 * 7/2001 Suzuki et al. ..... 399/67
6,349,187 B2 * 2/2002 Hayashi ..... 399/70
6,516,166 B2 * 2/2003 Sakakibara et al. ..... 399/69
2002/0061200 A1 * 5/2002 Sakakibara et al. ..... 399/69
2003/0095807 A1 5/2003 Fujimori et al. ..... 399/69
2004/0042825 A1 * 3/2004 Yasui et al. ..... 399/320

FOREIGN PATENT DOCUMENTS

JP 05-088582 A * 4/1993
JP 05-333624 12/1993
JP 10-142999 5/1998

* cited by examiner

*Primary Examiner*—Sophia S. Chen
(74) *Attorney, Agent, or Firm*—Fitzpatrick, Cella, Harper & Scinto

(57) ABSTRACT

A fixing apparatus for fixing a toner image on a recording material by heat has a pair of rotary members having a heat generating member, and rotatable in contact with each other, electric power supply controller for controlling electric power supply to the heat generating member so that the temperature of at least one of the rotary members may become a set temperature, and rotation time setting unit for setting a time for which the electric power supply control is effected after the shift from a warming-up operation to a fixing capable state and the pair of rotary members are rotated continuously from rotation during the warming-up operation, on the basis of the time of the warming-up operation.

8 Claims, 9 Drawing Sheets

| | | |
|---|---|---|
| 901 | WARMUP STATE | 190 |
| 902 | PRINT START STATE | 193 |
| 903 | PRINT FINISH STATE | 190 |
| 904 | EMERGENCY STOP STATE | 0 |

FIXING APPARATUS

BACKGROUND OF THE INVENTION

1. Field of the Invention

This invention relates to an image forming apparatus having fixing means for fixing a toner image formed on a recording material such as a transferring sheet, photosensitive paper or electrostatic recording paper by a suitable image forming process such as an electrophotographic recording process or an electrostatic recording process.

2. Description of Related Art

In image forming apparatuses such as conventional copying machines and printers, in order to fix an unfixed toner image on a recording material, use is widely be made of a fixing apparatus for passing a recording material through a nip part formed by a fixing roller and a pressure roller for nipping and conveying the recording material, to thereby fix the toner image by heat and pressure.

FIG. 11 of the accompanying drawings shows a cross section of a conventional roller type fixing apparatus. In FIG. 11, the reference numeral 101 designates a fixing roller, and the reference numeral 102 denotes a pressure roller. These rollers are rotatively driven at a predetermined peripheral speed in the directions of arrows. These two rollers 101 and 102 are brought into pressure contact with each other with a predetermined pressure force, whereby there is formed a fixing nip part N for nipping and conveying a recording material 109 on which there is unfixed toner t.

The fixing roller 101 has a mandrel 103 made of a metal or the like and formed into a cylindrical shape, and a heater 105 such as a halogen heater is inserted and disposed in the mandrel 103. This heater 105 generates heat by electrical energization and warms the mandrel 103. Further, heat is transmitted from the heater 105 to the mandrel 103 to thereby warm the surface of the fixing roller 101. A main temperature sensor 107 disposed correspondingly to the substantially length wisely central position of the fixing roller 101 for detecting the surface temperature of the fixing roller 101 detects the surface temperature of the fixing roller 101, and the detected temperature is inputted to a control circuit 110. The control circuit 110 control an electric power supplying circuit 111 for the heater 105 so that the detected temperature from the main temperature sensor 107 may become a preset temperature. Also, the reference numeral 108 designates a sub-surface temperature sensor disposed on an end portion (non-sheet passing area) of the fixing roller 101, and it serves to obviate the fixing apparatus from going wrong by the fixing roller being excessively heated due to the trouble or the like of the main temperature sensor 107.

FIG. 12 of the accompanying drawings shows a timing chart of a copying machine or a printer during the closing of a power switch in an example of the prior art. The reference numeral 201 represents the print starting state of the printer. From power-on timing 203, the printer enters a warming-up operation for increasing the surface temperature of the fixing roller to a fixing temperature, and at timing 204, it comes to a printing capable state.

On the other hand, the reference numeral 202 denotes a timing chart showing the rotation state of the fixing roller 101 and pressure roller 102 of the fixing apparatus shown in FIG. 11. The fixing roller 101 and the pressure roller 102 continue heating while being rotated until they come to the printing capable timing 204 at which the detection value of the main temperature sensor 107 reaches a print starting temperature, in order to uniformly transmit the heat to the entire fixing roller and to transmit the heat of the fixing roller to the pressure roller.

In such a construction, depending on the state of the fixing roller or the pressure roller during the closing of the power switch, when the temperature of the fixing roller comes to a printing temperature and the printing capable timing 204 is reached, there is a case where the surface of the pressure roller is warmed but the entire pressure roller is not warmed. As a result, even after the printing capable timing 204 has been reached, there is a case where the heat from the surface of the pressure roller is radiated in some time and a fixing property is not satisfied. Therefore, as described in Japanese Patent Application Laid-Open No. 10-142999, after the printing capable timing 204, the pressure roller is further rotated while being controlled at a predetermined temperature for a predetermined time (T), whereby the entire pressure roller can be warmed. In Japanese Patent Application Laid-Open No. 5-333624, there is described a construction in which a pressure roller has a heater such as a halogen heater-therein, and even in such a construction, if usable electric power is limited, sufficient electric power cannot be supplied to the heater in the pressure roller and therefore, the pressure roller cannot be sufficiently warmed by this heater alone and therefore, in some cases, the construction of Japanese Patent Application Laid-Open No. 10-142999 is adopted. However, in a method of making the rotation time after the printing capable timing 204 constant, there is a case where the pressure roller cannot be sufficiently warmed depending on environment, or there is the problem that in spite of the pressure roller being sufficiently warm, idle rotation is uselessly effected and consumed electric power becomes great. On the other hand, in Japanese Patent Application Laid-Open No. 62-87909, there is described a method of determining the idle rotation time during the raising operation from a temperature rise rate during some of a rising time. However, judging from some of the time, the degree to which the pressure roller is warmed cannot be judged accurately when the surface of the pressure roller is warm but the mandrel portion is cold. Therefore, it is desirable to grasp how much the pressure roller has been warmed during the raising time, and determine the idle rotation time.

SUMMARY OF THE INVENTION

It is an object of the present invention to prevent faulty fixing after rising.

It is another object of the present invention to achieve the shortening of a raising time.

It is a further object of the present invention to provide a fixing apparatus for fixing a toner image on a recording material by heat, having:

a pair of rotary members having a heat generating member, and rotatable in contact with each other;

electric power supply control means for controlling electric power supply to the heat generating member so that the temperature of at least one of the rotary members may become a set temperature; and rotation time setting means for setting a time for which the electric power supply control is effected after the shift from a warming-up operation to a fixing capable state and the pair of rotary members are rotated continuedly from rotation during the warming-up operation, on the basis of the time of the warming-up operation.

Further objects of the present invention will become apparent from the following description.

DETAILED DESCRIPTION OF THE PREFERRED EMBODIMENTS (First Embodiment)

(1) Example of an Image Forming Apparatus

Figure 1:
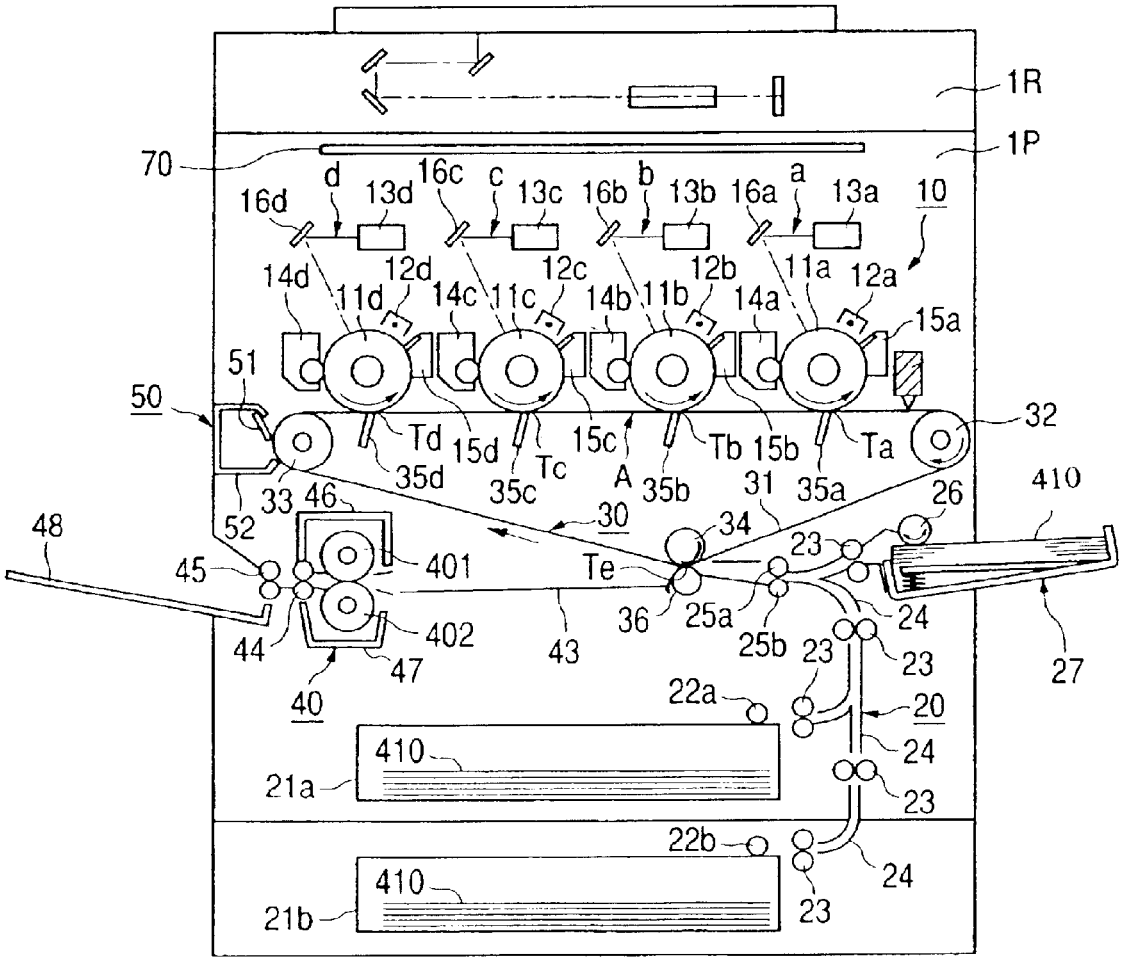
FIG. 1 illustrates an image forming apparatus according to a first embodiment of the present invention.

FIG. 1 schematically shows the construction of an image forming apparatus according to a first embodiment. The image forming apparatus according to the present embodiment is a tandem type electrophotographic color image forming apparatus using an intermediate transferring belt. This image forming apparatus itself is a known one and will be described only briefly.

The reference character 1R designates an original reading portion used when the operation of copying an original is performed. The reference character 1P denotes an image output portion broadly comprised of an image forming portion 10 (having four stations a, b, c and d juxtaposed and identical in construction with one another), a sheet feeding unit 20, an intermediate transferring unit 30, a fixing unit 40 and a control unit (not shown).

The individual units will hereinafter be described in greater detail. The image forming portion 10 is of a construction as will be described below. Photosensitive drums 11*a*, 11*b*, 11*c* and 11*d* as image bearing members are journalled at their centers and are rotatively driven in the directions of respective arrows. In opposed relationship with the outer peripheral surfaces of the photosensitive drums 11*a*–11*d* and in the directions of rotation thereof, there are disposed primary electrifiers 12*a*, 12*b*, 12*c* and 12*d* as electrifying members for electrifying the photosensitive drums to predetermined potential, optical systems 13*a*, 13*b*, 13*c* and 13*d* reflecting off mirrors 16*a*–16*d* for forming electrostatic latent images on the photosensitive drums 11*a*–11*d*, and developing apparatuses 14*a*, 14*b*, 14*c* and 14*d* for forming toner images on the photosensitive drums. By the primary electrifiers 12*a* to 12*d*, charges of a uniform charging amount are given to the surfaces of the photosensitive drums 11*a* to 11*d*.

Then, by the optical systems 13*a* to 13*d*, the photosensitive drums 11*a* to 11*d* are exposed to beams such as laser beams modulated in conformity with a recording image signal to thereby form electrostatic latent images thereon. Further, the electrostatic latent images are visualized by the developing apparatuses 14*a* to 14*d* containing therein developers (toners) of four colors such as yellow, cyan, magenta and black. Downstream of image transferring areas Ta, Tb, Tc and Td for transferring the visualized visible images to an intermediate transferring member, any toners not transferred to a recording material (transferring material) but residual on the photosensitive drums 11*a* to 11*d* are scraped off by cleaning apparatuses 15*a*, 15*b*, 15*c* and 15*d* to thereby effect the cleaning of the drum surfaces. By a process shown above, image forming by the respective toners is sequentially effected.

The sheet feeding unit 20 comprises cassettes 21*a*, 21*b* and a manual feeding tray 27 for containing recording materials 410 therein, pickup rollers 22*a*, 22*b* and 26 for feeding the recording materials 410 one by one out of the cassettes or the manual feeding tray, a pair of sheet feeding rollers 23 and a sheet feeding guide 24 for conveying the recording materials 410 fed out by the pickup rollers to registration rollers, and registration rollers 25*a*, 25*b* for conveying the recording materials 410 to a secondary transferring area Te in timed relationship with the image forming by the image forming portion.

The intermediate transferring unit 30 will now be described in detail. An intermediate transferring belt 31 (the material of which is polyethylene terephthalate (PET), polyvinylidene fluoride (PvdF) or the like) is passed over a drive roller for transmitting drive to the intermediate transferring belt 31, a tension roller 33 for giving moderate tension to the intermediate transferring belt 31 by the biasing force of a spring (not shown), and a driven roller 34 opposed to the secondary transferring area Te with the belt interposed therebetween. A primary transferring plane A is formed between the drive roller 32 and the tension roller 33. The drive roller 32 has a metallic roller having its surface coated with rubber (urethane or chloroprene) having a thickness of several millimeters to thereby prevent the slip thereof relative to the belt. The drive roller 32 is rotatively driven by a pulse motor (not shown). In the primary transferring areas Ta-Td wherein the respective photosensitive drums 11*a* to 11*d* and the intermediate transferring belt 31 are opposed, primary transferring blades 35*a*–35*d* are disposed on the back of the intermediate transferring belt 31. A secondary transferring roller 36 is disposed in opposed relationship with the driven roller 34, and by the nip thereof with the intermediate transferring belt 31, there is formed the secondary transferring area Te. The secondary transferring roller 36 is pressed against the intermediate transferring member with moderate pressure. Also, on the intermediate transferring belt and downstream of the secondary transferring area Te, there is disposed a cleaning apparatus 50 for cleaning the image forming surface of the intermediate transferring belt 31, and this cleaning apparatus 50 comprises a cleaner blade 51 (the material of which is polyurethane rubber or the like) and a waste toner box 52 for containing waste toners therein.

The fixing apparatus (fixing unit) 40, as will be described in item (2) below, comprises a fixing roller 401 which is a rotary member provided therein with a heat source such as a halogen heater as a heat generating member, a pressure roller 402 which is a rotary-member pressing the fixing roller, a recording material inlet guide for directing the recording material 410 to a fixing nip part formed by the pair of fixing rollers as a pair of rotary members, and inner sheet discharging rollers 44 and outer sheet discharging rollers 45 for directing the recording material 410 discharged from the pair of fixing rollers to the outside of the image forming apparatus.

The control unit comprises a control substrate 70 for controlling the operation of a mechanism in each of the above-described units, a motor drive substrate, etc.

Description will now be added in conformity with the operation of the image forming apparatus. When an image forming operation start signal is generated, the recording materials 410 are first fed out one by one from the cassette 21*a* by the pickup roller 22*a*. The recording material 410 is then guided through the sheet feeding guide 24 by the pair of sheet feeding rollers 23 and is conveyed to the registration rollers 25*a* and 25*b*. At that time, the registration rollers are stopped and the leading edge of the sheet strikes against the nip part. Thereafter, the registration rollers begin to be rotated in timed relationship with the image forming portion starting the formation of an image. This rotation period has its timing set so that the recording material 410 and the toner image primary-transferred from the image forming portion onto the intermediate transferring belt may just coincide with each other in the secondary transferring area Te.

On the other hand, in the image forming portion, when the image forming operation start signal is generated, the toner image formed on the photosensitive drum 11*d* most upstream with respect to the direction of rotation of the intermediate transferring belt 31 by the aforedescribed process is primary-transferred to the intermediate transferring belt 31 in the primary transferring area Td by the primary transferring electrifier 35*d* to which a high voltage has been applied. The primary-transferred toner image is carried to the next primary transferring area Tc. There image forming is being effected with a delay of a time during which the toner image is carried between adjacent ones of the image forming portions, and the next toner image is transferred onto the preceding image in registered relationship with the latter. Thereafter, a similar process is repeated and after all, the toner images of four colors are primary-transferred onto the intermediate transfer belt 31.

Thereafter, the recording material 410 comes into the secondary transferring area Te and contacts with the intermediate transferring belt 31, whereupon in timed relationship with the passage of the recording material 410, a high voltage is applied to the secondary transferring roller 36. The toner images of four colors formed on the intermediate transferring belt by the aforedescribed process are then transferred to the surface of the recording material 410. Thereafter, the recording material 410 is accurately guided to the fixing roller nip part by a conveying guide 43. The toner images are fixed on the recording material by the heat and pressure of the pair of fixing rollers 401 and 402. Thereafter, the recording material is conveyed by the inner and outer sheet discharging rollers 44 and 45 and is discharged onto a sheet discharging tray 48 outside the image forming apparatus.

(2) Fixing Apparatus

Figure 2:
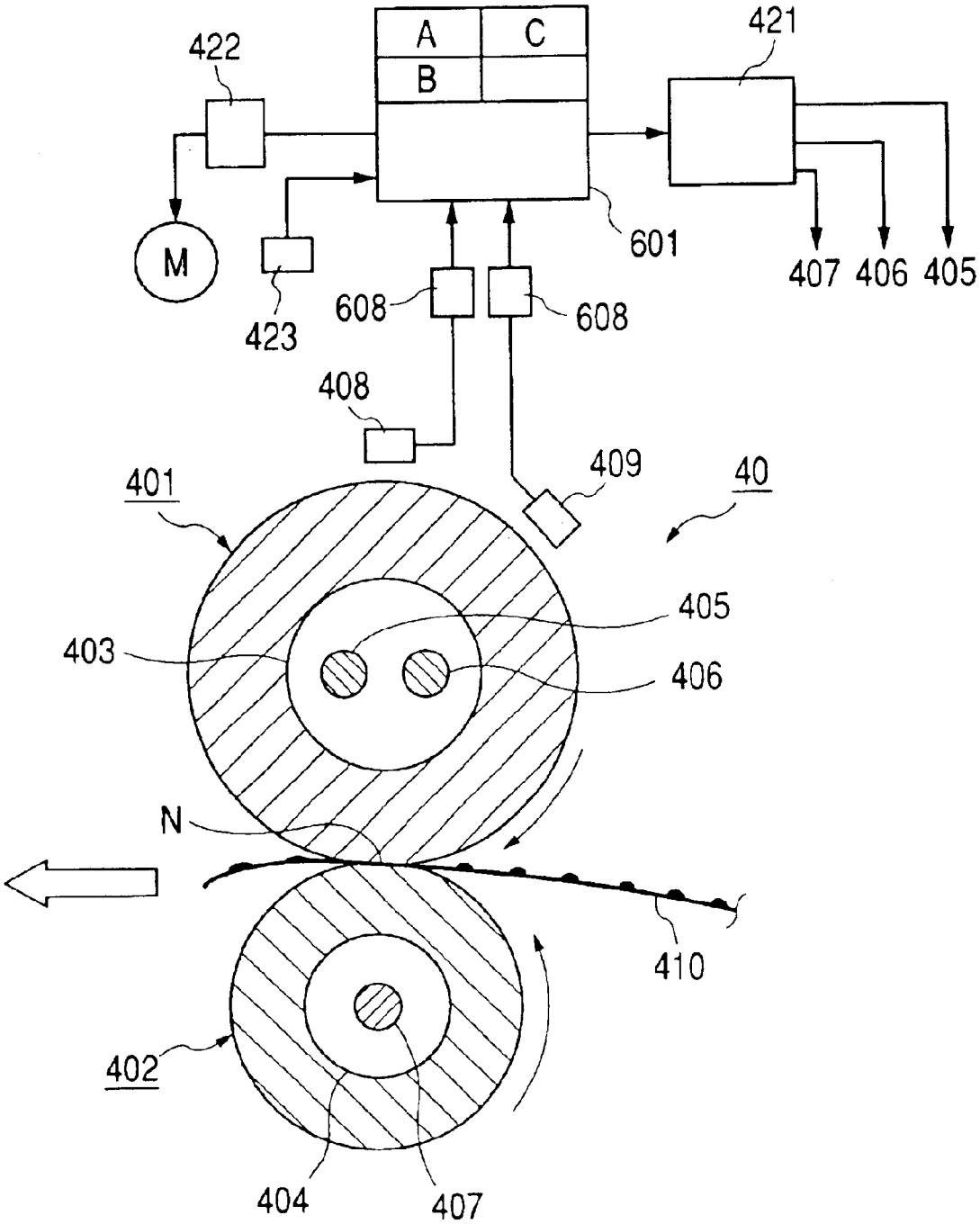
FIG. 2 illustrates a fixing apparatus in the first embodiment.

FIG. 2 schematically shows the construction of the fixing apparatus in the present embodiment. The reference numeral 401 designates the fixing roller, and the reference numeral 402 denotes the pressure roller. These two rollers 401 and 402 are brought into pressure contact with each other with a predetermined pressure force of e.g. 50 kgf to thereby form a fixing nip part N, and are rotatively driven in the directions of arrows at a predetermined peripheral speed, e.g. 300 mm/sec.

The fixing roller 401 has a first fixing heater (such as a halogen heater) 405 and a second fixing heater (such as a halogen heater) 406 inserted and disposed in a mandrel 403 formed of a metal such as iron and formed into a cylindrical shape having a thickness of 1.5 mm. These fixing heaters 405 and 406 generate heat by being electrically energized, and warm the mandrel 403. Also, a rubber layer formed of silicone rubber which is an elastic layer having a thickness of 2.3 mm is formed on the outer layer of the mandrel 403. Further, a mold releasing layer formed of fluorine resin or the like and having a thickness of 50 $\mu$m is provided on the outer layer of the rubber layer.

A main temperature sensor 408 which is a temperature detecting member is disposed at the substantially length wisely central position of the fixing roller 401 for detecting the surface temperature of the fixing roller 401, and detected temperature information which is the output of the main temperature sensor 408 is inputted to a control circuit (CPU) 601 through an A/D converter 608. The CPU 601 controls the amount of electric power supply to the fixing heaters 405 and 406 by an electric power supply circuit 421, on the basis of the detected temperature information from the main temperature sensor 408, so that the surface temperature of the fixing roller 401 may become a preset temperature. That is, it controls the switch-on of the fixing heaters 405 and 406 so as to keep the surface temperature of the fixing roller 401 at a predetermined temperature.

In the present embodiment, the heat generation distribution of the heaters is set so that the first fixing heater 405 (main heater) can supply more heat to the central portion of the fixing roller 401 than to the opposite end portions thereof, and the second fixing heater 406 (sub-heater) can supply more heat to the opposite end portions of the fixing roller 401 than to the central portion thereof. Also, the switch-on control of the second fixing heater 406 is selected and effected from a plurality of switch-on time duties depending on the width of the supplied recording material 410.

The CPU 601 converts the analog output values of the aforedescribed main'temperature sensor 408 and sub-fixing temperature sensor 409 into digital data to thereby measure the surface temperature of the fixing roller.

As previously described, the fixing heater is constituted by the two heaters 405 and 406, whereby not only the amount of heat of the fixing roller 401 can be increased, but also the temperature of the end portions of the fixing roller on which paper does not pass can be prevented from rising abnormally when paper having a narrow width is to be fixed.

Also, the reference numeral 409 designates a sub-surface temperature sensor disposed correspondingly to the end portions (non-sheet passing areas) of the fixing roller 401, and the detected temperature information by this temperature sensor 409 is inputted to the CPU 601. The CPU 601 emergently intercepts the supply of electric power to the fixing heaters 405 and 406 when the input detected temperature information from the temperature sensor 409 becomes equal to or higher than a predetermined limit temperature. That is, the sub-surface temperature sensor 108 has the role of obviating the fixing roller from being excessively heated to thereby damage the fixing apparatus when it becomes impossible due to the trouble or the like of the main temperature to correctly read the surface temperature of the fixing roller.

The reference numeral 402 denotes a pressure roller as a pressure rotary member against which the fixing roller 401 is urged to thereby form a fixing nip part N for nipping and conveying the recording material. The pressure roller 402 comprises a mandrel 404 as a base layer formed of a metal such as iron and having a thickness of 2.5 mm, a rubber layer which is an elastic layer provided on the upper layer of the mandrel and formed of silicone rubber and having a thickness of 2.3 mm, and a mold releasing layer formed of fluorine resin and having a thickness of 50 $\mu$m.

When the recording material 410 passes through the fixing nip part N which is the pressure contact portion between the fixing roller 401 and the pressure roller 402 while being nipped by the fixing nip part N, heat for fixing the toner image t on the recording material 410 is given to the toner.

The reference numeral 407 designates a temperature keeping heater (halogen heater) as a heat generating member inserted and disposed in the cylindrically shaped mandrel 404 of the pressure roller 402, and electric power supply to this temperature keeping heater 404 is designed to be controlled during print standby. That is, during print standby, the temperature keeping heater 404 conducts a constant amount of heat to the pressure roller 402 through the mandrel 404 and keeps the temperature of the pressure roller, whereby the hat of the pressure roller during the standby can be maintained. This temperature keeping heater has its heat generation amount set to a small amount because the usable electric power of the image forming apparatus main body is limited.

The letter M denotes a fixing motor for rotatively driving the fixing roller 401 and the pressure roller 402, and it is drive-controlled by the CPU 601 through a controller 422. The reference numeral 423 designates an environment sensor for detecting the temperature and humidity in the printer, and temperature and humidity information detected by the environment sensor 423 in the printer is inputted to the CPU 601. The CPU 601 which is control means has an accumulated heat amount foreseeing function portion A for foreseeing the accumulated heat amount of the fixing apparatus, and particularly the accumulated heat amount of the rotary members, a rotation time setting portion B for setting the idle rotation time of the fixing apparatus, and particularly the idle rotation time of the pair of rotary members, an idle rotation executing function portion C for executing idle rotation for the time determined by the idle rotation time setting portion B, etc.

Figure 3:
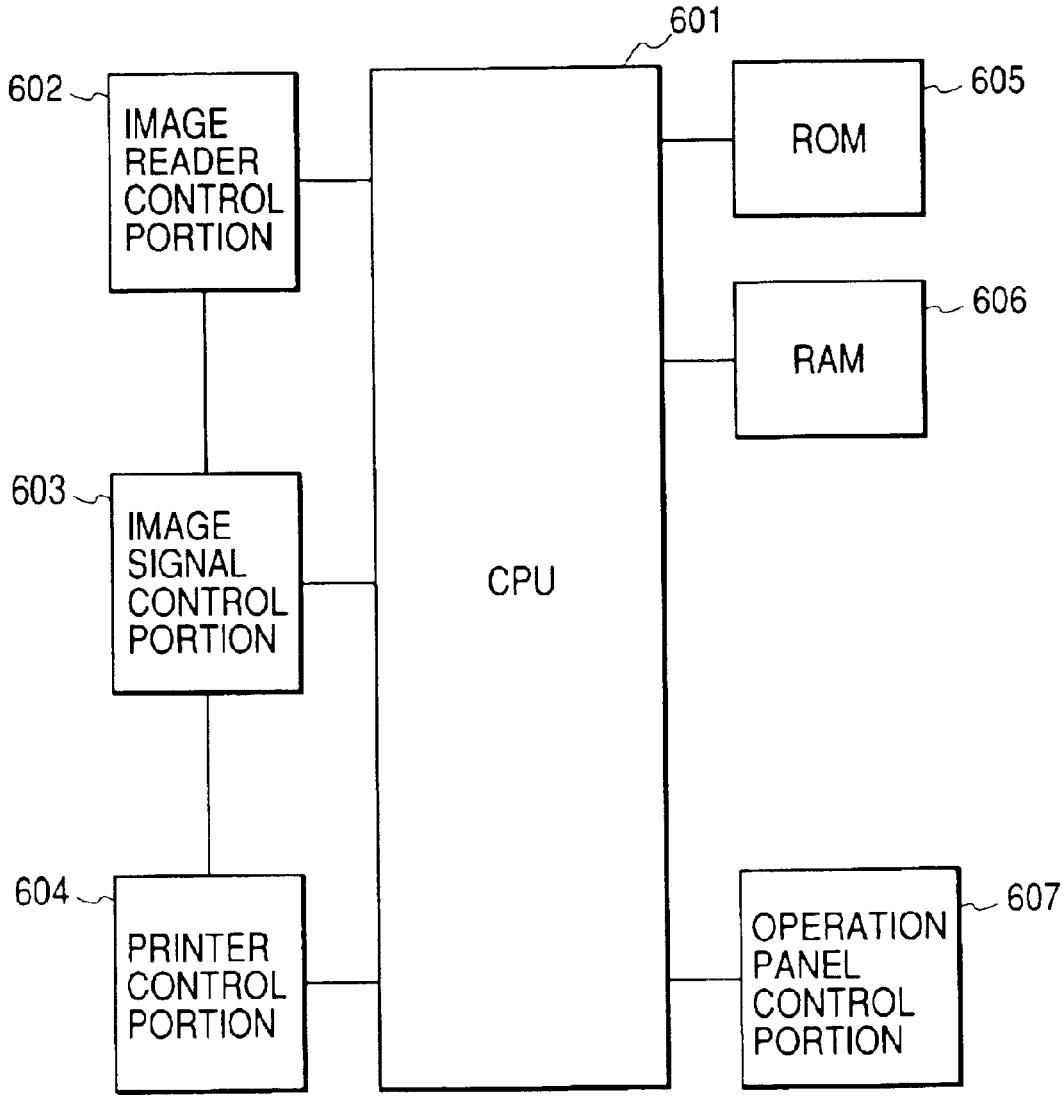
FIG. 3 illustrates the control circuit of the image forming apparatus according to the first embodiment.

FIG. 3 is a block diagram showing the construction of a controller for controlling the image forming apparatus according to the present embodiment, and the controller is comprised of the CPU 601, an image reader control portion 602, an image signal control portion 603, a printer control portion 604, a ROM 605, a RAM 606 and an operation panel control portion 607.

The CPU 601 executes a program stored in the ROM 605 to thereby control an original reading portion 1R through the image reader control portion 602.

The image signal control portion 603 accumulates therein the image data of an original read from the original reading portion 1R or image data inputted to the image signal control portion 603 through a network, and outputs print data to the printer control portion 604.

The CPU 601 controls an operation panel (not shown) through the operation panel control portion 607.

Figure 4:
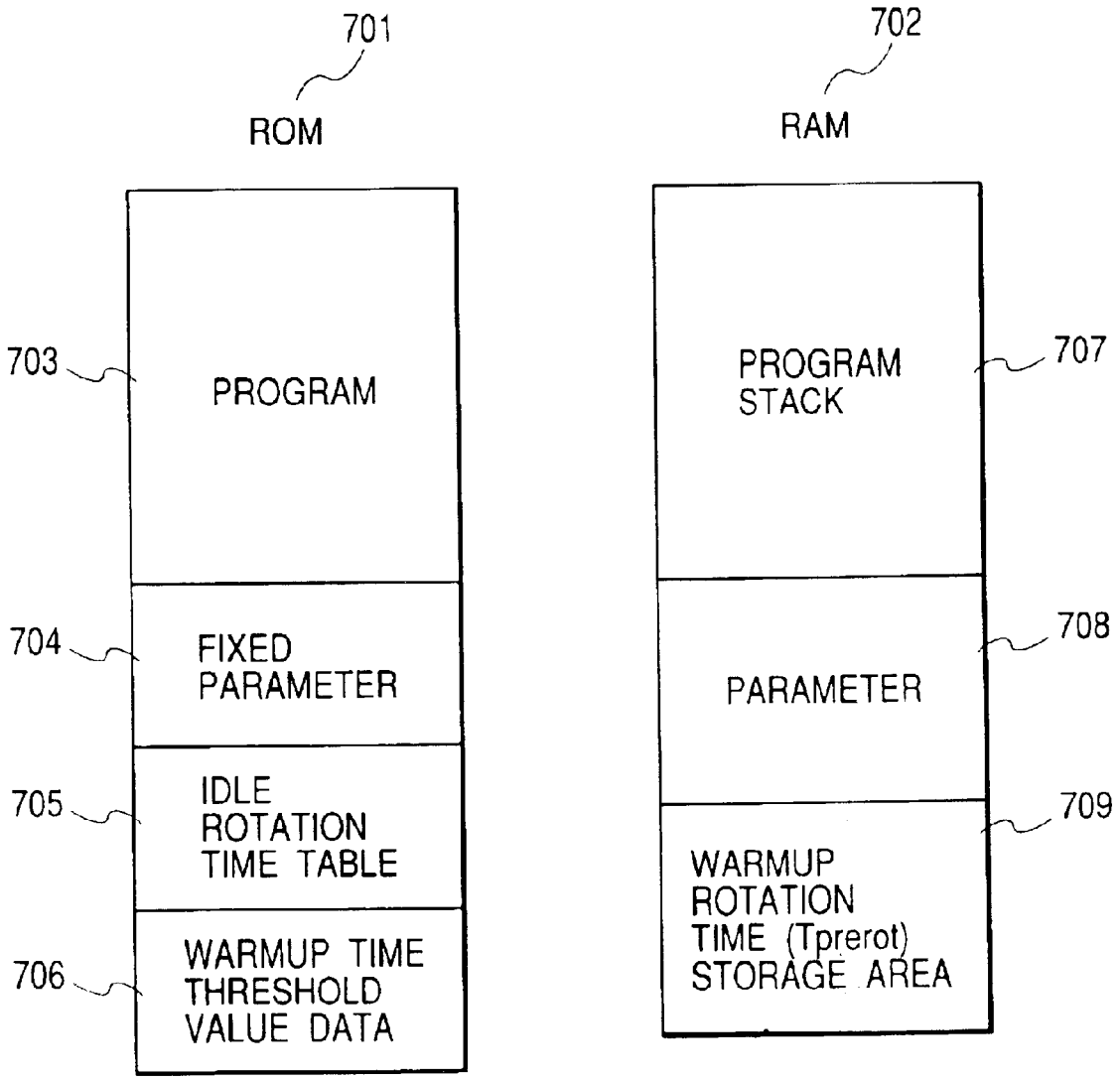
FIG. 4 illustrates the ROM and RAM maps of the control-circuit of the image forming apparatus according to the first embodiment.

FIG. 4 shows the area allotment of the ROM 605 and the RAM 606. The reference numeral 701 designates data stored in the ROM 605, and this data is comprised of an area 703 in which a program is stored, an area 704 in which a fixed parameter necessary for the execution of the program is stored, a fixing motor idle rotation time table 705 and warmup time threshold value data 706 for determining the idle rotation time from the idle rotation time table.

The reference numeral 702 denotes the area allotment of the RAM 606 which is comprised of a stack area 707 necessary for the execution of the program, a variable area 708 and a variable area 709 storing therein a measured warmup rotation time.

Figures 5, 6:
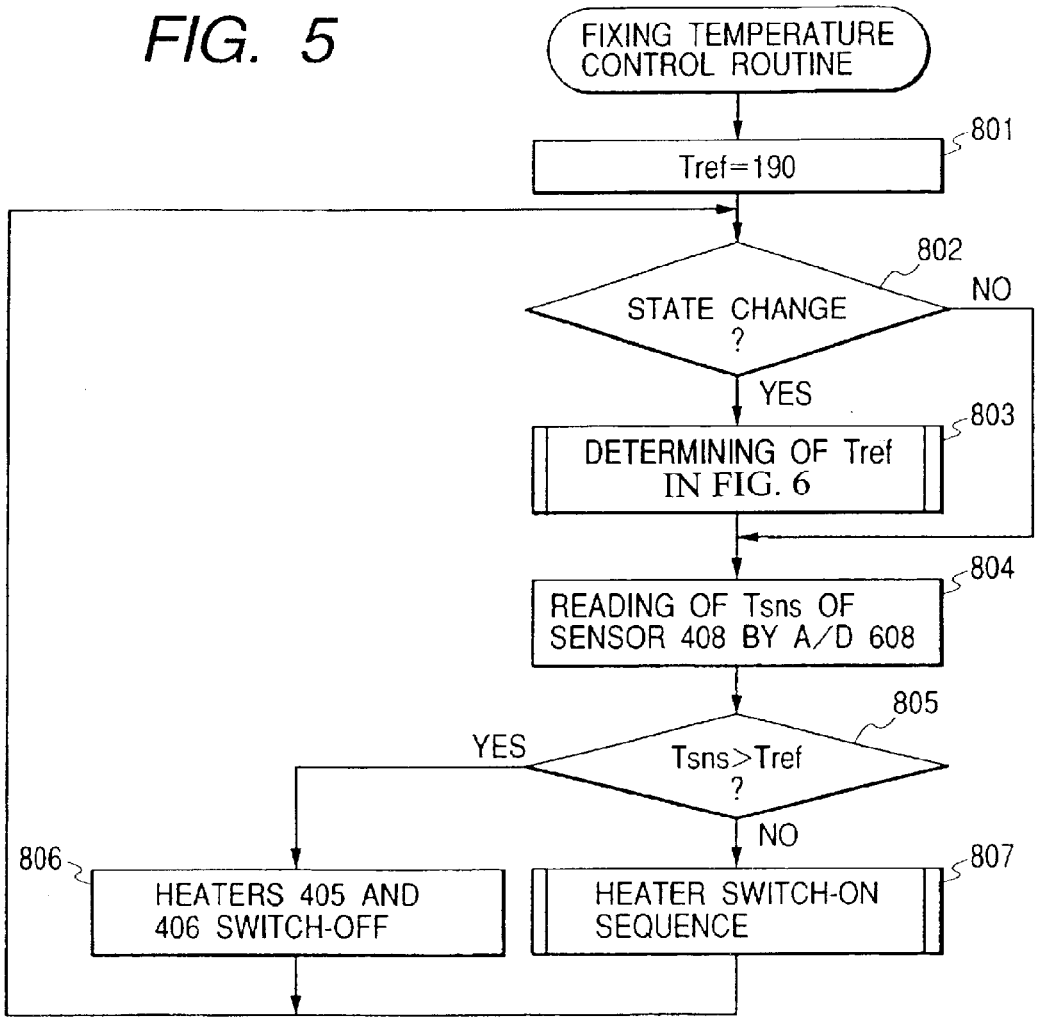
FIG. 5 illustrates the control algorism of the fixing apparatus in the first embodiment.
FIG. 6 illustrates the state of the image forming apparatus according to the first embodiment and the control temperature of the fixing apparatus.

Reference is now had to FIG. 5 to describe the temperature control algorism of the fixing apparatus 40 shown in FIG. 1 which is controlled by the CPU 601.

First, after the closing of a power switch, at 801, an initial value 190° C. which is a target temperature during a warming-up operation is stored in the control target temperature storing variable Tref of the fixing apparatus. When the temperature of the fixing roller reaches this temperature, the warming-up operation is terminated and shifts to an image forming capable state. Next, at 802, reference is had to a table shown in FIG. 6, and the control target temperature Tref is changed in accordance with the state of the image forming apparatus (803). Next, a value obtained by converting the input value of the temperature sensor 408 is stored from an A/D converter 608 into Tsns (804). Next, at 805, the control target temperature Tref and the detected temperature Tsns are compared with each other (805), and if Tsns is equal to or less than Tref, the first fixing heater 405 and the second fixing heater 406 are switch-on-controlled by a heater switch-on sequence shown in FIG. 7 (807). On the other hand, if Tsns exceeds Tref, at 806, the first fixing heater 405 and the second fixing heater 406 are not switched on.

FIG. 6 is a table representing the relation between the state of the image forming apparatus and the set value of Tref. The reference numeral 901 indicates the control temperature during warmup which is a preparing operation for an image forming capable state in which the image forming apparatus 40 is warming up. The reference numeral 902 indicates the control temperature when print has been started. The reference numeral 903 indicates the control temperature when print has been finished, and it is equal to the starting temperature during warmup. Also, reference numeral 904 indicates that in a state in which the image forming apparatus need be emergently stopped due to paper jam or the like, the control temperature is set at 0° C. to thereby control the heater so as not to be switched on. Also, the CPU 601 effects the control of rotating the fixing roller 401 and the pressure roller 402.

Figure 7:
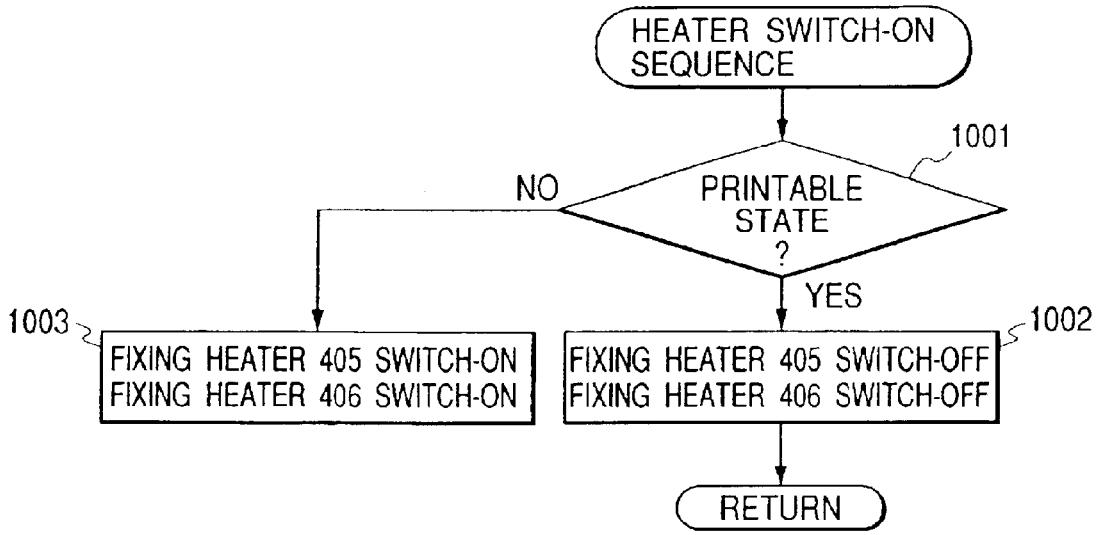
FIG. 7 illustrates the fixing heater switch-on sequence of the image forming apparatus according to the first embodiment.

FIG. 7 shows the fixing heater switch-on sequence described in connection with FIG. 5. At 1001, whether the image forming apparatus is in an image forming capable state which is a fixing capable state is judged. In the case of a standby state in which image forming is possible and an image forming signal is being waited for, the first fixing heater 405 is switched off and the second fixing heater 406 alone is switched on to prevent the rise in the internal temperature of the image forming apparatus, and reduce consumed electric power (1002). On the other hand, in the other cases than the standby state, it is necessary to give a sufficient amount of heat to the fixing roller and therefore, both of the fixing heaters 405 and 406 are switched on (1003).

Figure 8:
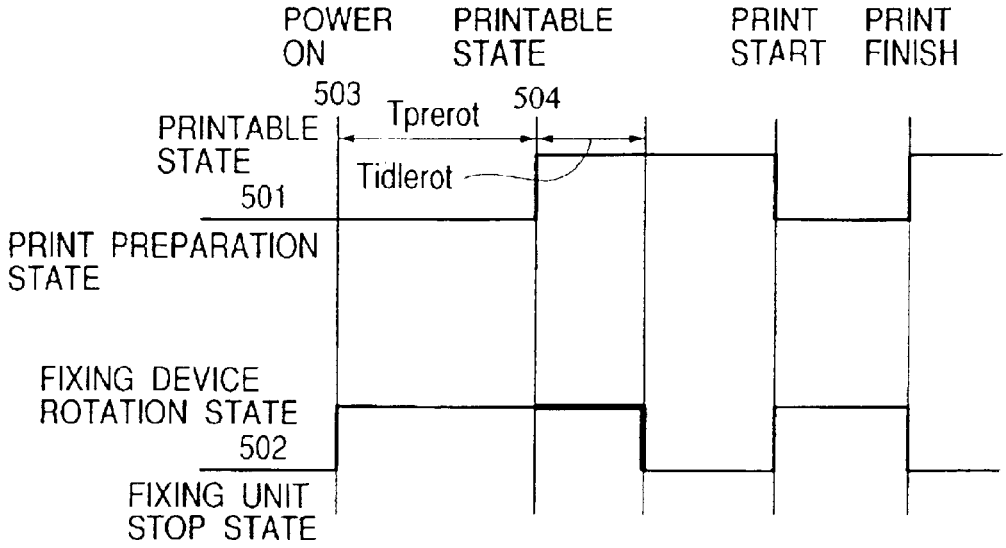
FIG. 8 shows a time chart from the closing of the power switch of the image forming apparatus according to the first embodiment till the finish of print.

FIG. 8 shows a control time chart of the fixing apparatus in the present embodiment from the closing of the power switch till the end of print. The reference numeral 501 represents that the printer is in the standby state. From power on timing 503, the printer enters a warming-up operation, and at timing 504, it comes to the standby state.

On the other hand, the reference numeral 502 indicates a timing chart showing the rotation states of the fixing roller 401 and pressure roller 402 of the fixing apparatus shown in FIG. 2. The fixing roller 401 and the pressure roller 402 continue heating while being rotated until printing capable timing 504 at which the printer assumes the standby state is reached after the closing of the power switch, in order to uniformly transmit heat to the entire fixing roller and quickly raise the surface temperature of the roller. While in the present embodiment, the rotation of the fixing roller and the pressure roller has been started after the closing of, the power switch, use may be made of a rotation sequence in which the fixing roller is heated while being stopped until the surface temperature of the fixing roller reaches a predetermined temperature, and after the predetermined temperature has been reached, rotation is started.

Next, the CPU 601 counts the time required to shift from the power on 503 to the printing capable state 504, and stores it in Tprerot storing area 709 in the RAM 605 (FIGS. 3 and 4). Next, from immediately after the printing capable timing 504 has been reached until an image forming signal is inputted, idle rotation is continued for an idle rotation time Tidlerot determined in FIG. 9, whereby in the standby state, heat is uniformly transmitted from the mandrel 403 and the mandrel 404 to the entire rollers and therefore, it becomes possible to keep a stable fixing property. As regards the rotational speed in the present embodiment, the rotational speed before the printing capable timing 504 is reached and the rotational speed of the idle rotation during the print standby state are the same.

Also, even if the image forming signal is inputted during this idle rotation, it is possible to fix the toner image on the recording material and therefore, the warmup time was not extended, nor the operability was lost.

Figure 9:
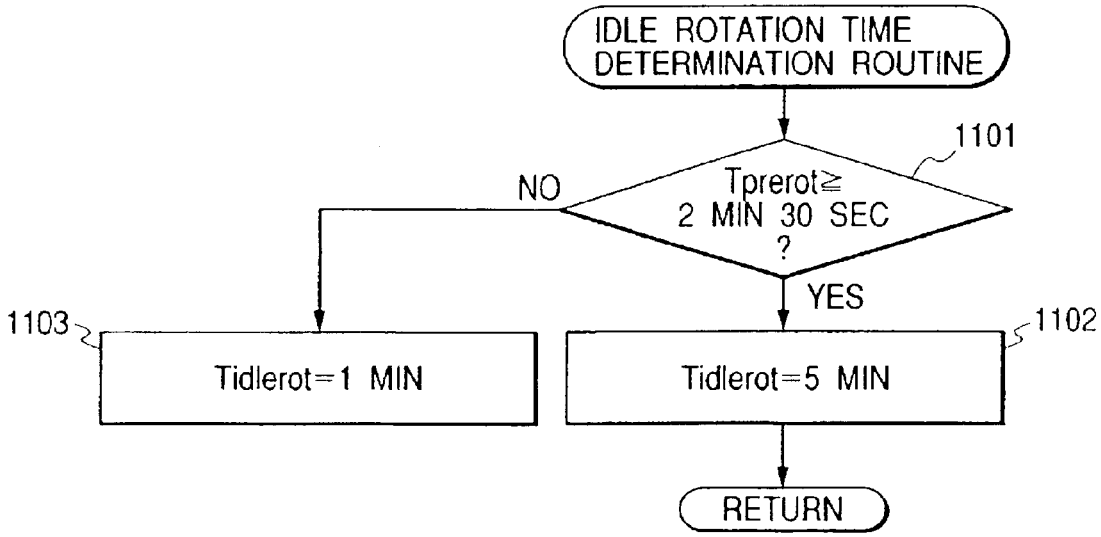
FIG. 9 illustrates the idle rotation time determination routine of the fixing roller of the image forming apparatus according to the first embodiment.

Further, by FIG. 9, the optimum idle rotation time is found from Tprerot and therefore, even if the power switch is closed in a state in which the fixing roller has been sufficiently warmed, useless idle rotation is not effected, and even if the power switch is closed from a state in which the power switch has not been closed for a long time, it never happens that the fixing property is aggravated.

FIG. 9 mentioned previously shows an idle rotation time Tidlerot determination routine. At 1101, whether the warmup time Tprerot is longer than a threshold value of 2 minutes 30 seconds stored in warmup time threshold value data 706 (FIG. 4) described in the present embodiment is judged (1101). If it is longer (1102), the amount of accumulated heat in the mandrels 403 and 404 is judged to be small, and a set value of 5 minutes taken out of data 705 (idle rotation time table) is set to Tidlerot. If it is shorter (1103), a set value of 1 minute likewise taken out of the data 705 is set to Tidlerot. Regarding the temperature control of the fixing roller during this idle rotation, taking into consideration the proper fixing property when the image forming signal is inputted during the idle rotation, it is preferable to be controlled at the set temperature in the standby state. As described above, in the present embodiment, if the warmup time is long, the pressure roller before the start of the warmup is considered to be cold and the pressure roller cannot be sufficiently warmed within this warmup time and therefore, the idle rotation time after the shift to the standby state is set to a long time. On the other hand, when the warmup time is short, the pressure roller is considered to be warm from before the start of the warmup, and the idle rotation time is set to a short time in order to eliminate any useless idle rotation.

In the present embodiment, when measuring the time from a predetermined period during warmup until fixing becomes possible, the time from the closing of the power switch as the predetermined period, i.e., a period during which the supply of electric power to the heat generating member is started and pre-rotation is started, until fixing becomes possible was measured to thereby fix the idle rotation time after the shift to a fixing capable state. As other embodiment, in a warmup sequence wherein during the closing of the power switch, the fixing roller and the pressure roller are heated in their stopped states, and the fixing roller and the pressure roller effect pre-rotation after the surface temperature of the fixing roller has reached a predetermined temperature, the time from the closing of the power switch until fixing becomes possible may be measured and by the use of that time, the idle rotation time after the shift to an image forming capable state may be found. Also, if there is a time from the closing of the power switch till the start of the supply of electric power to the heater, the time from the start of the supply of electric power to the heater until shift is made to the image forming capable state may be measured to thereby find the idle rotation time after the shift to the image forming capable state.

Design may be made such that there are a plurality of threshold values of Tprerot time which determines Tidlerot in FIG. 9 and the finer setting of the idle rotation time of the fixing roller can be effected in conformity with the foreseen amount of accumulated heat of the mandrel, i.e., the degree of warmup of the pressure roller.

Further, in the first embodiment, the idle rotation speed of the pre-rotation during warmup and the speed of the idle rotation in the standby state were the same, but when the quietude of the image forming apparatus in the standby state is taken into account, the fixing roller may preferably be rotated at the lowest possible speed. That is, by the rotation speed of the idle rotation in the standby state being made lower than the rotation speed of the pre-rotation during warmup, the quietude of the image forming apparatus in the standby state and a stable fixing property can be realized at a time.

Also, while the idle rotation time during the standby state was found by the use of the required time from the predetermined timing during warmup until shift is made to the standby state, judgment may be done by the use of not only this required time, but also environmental temperature and humidity such as the temperature and humidity in the machine.

Also, while the present embodiment adopts the construction of a pair of rotary members comprising a fixing roller and a pressure roller, the present invention can also be applied to the construction of a pair of rotary members comprising a fixing roller and an outside heating roller for heating the fixing roller from outside, as another example of the pair of rotary members. The outside heating roller has a heat generating member such as a halogen heater provided in a roller formed of a metal or the like, and the heat of this heat generating member heats the surface of the fixing roller through the roller.

(Second Embodiment)

Figure 10:
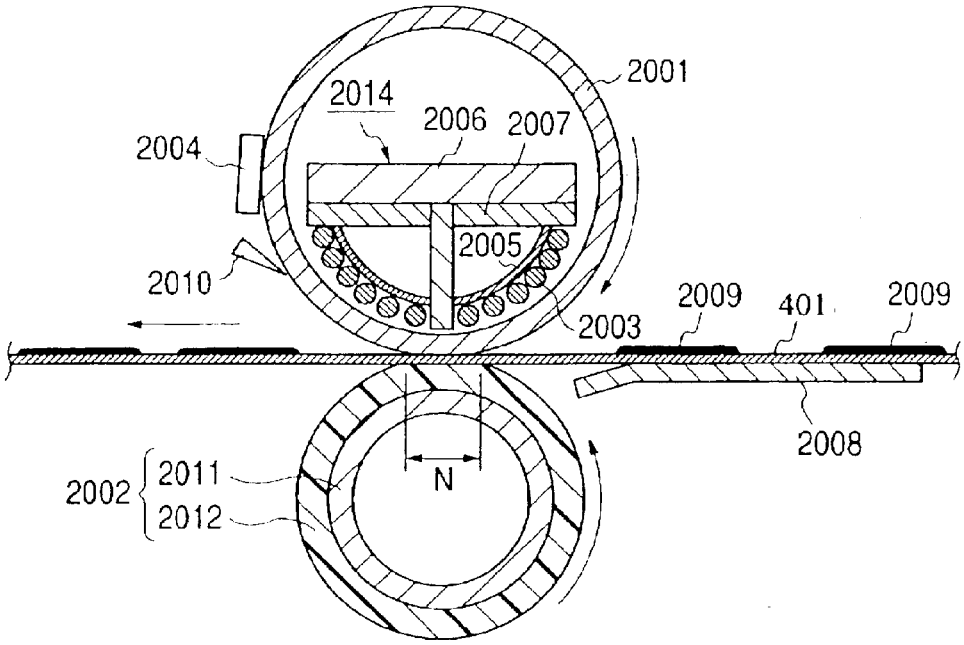
FIG. 10 is a cross-sectional view of a fixing apparatus in a second embodiment of the present invention.
Figure 11:
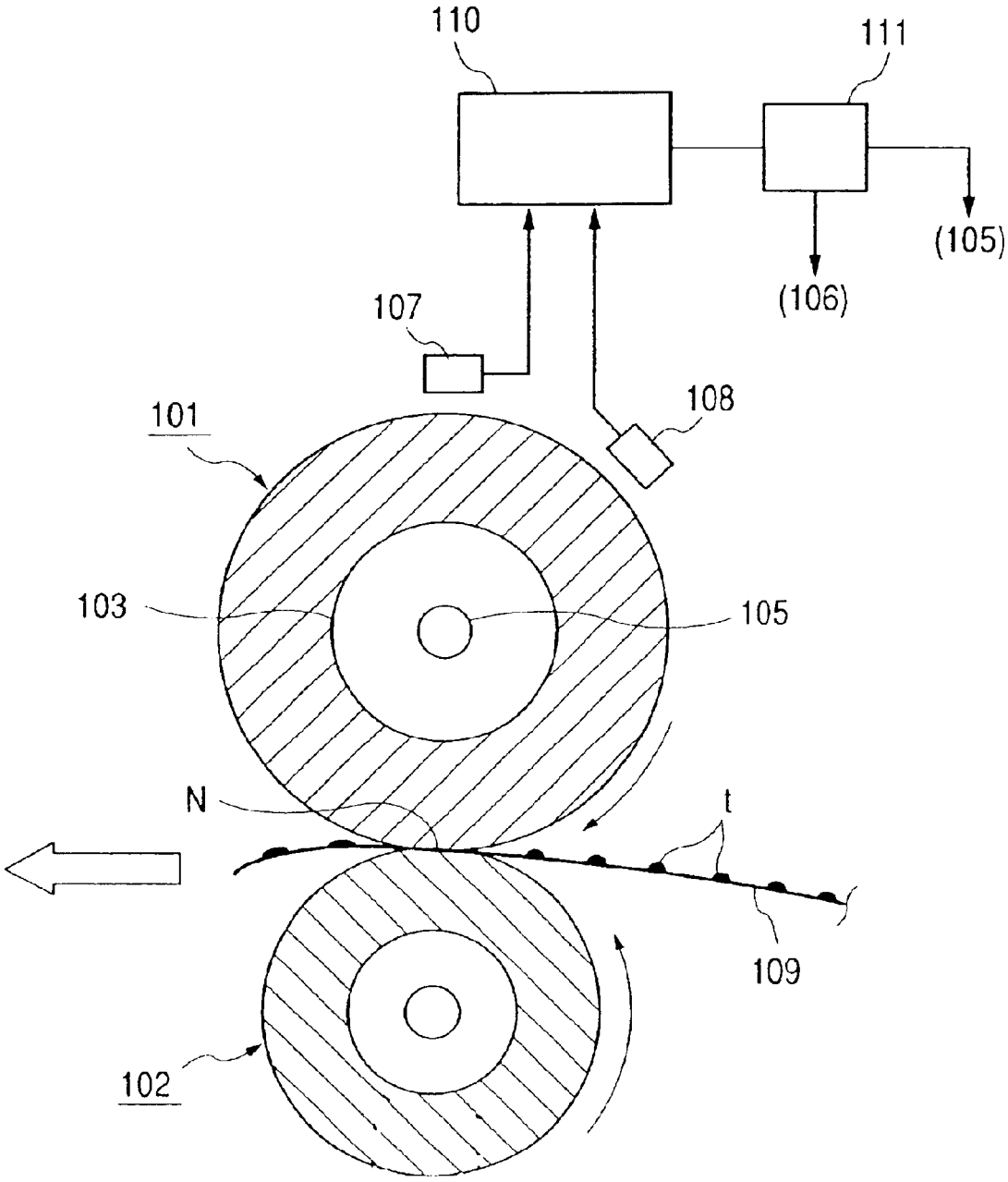
FIG. 11 PRIOR ART
FIG. 11 illustrates the fixing apparatus of an image forming apparatus according to an example of the prior art.
Figure 12:
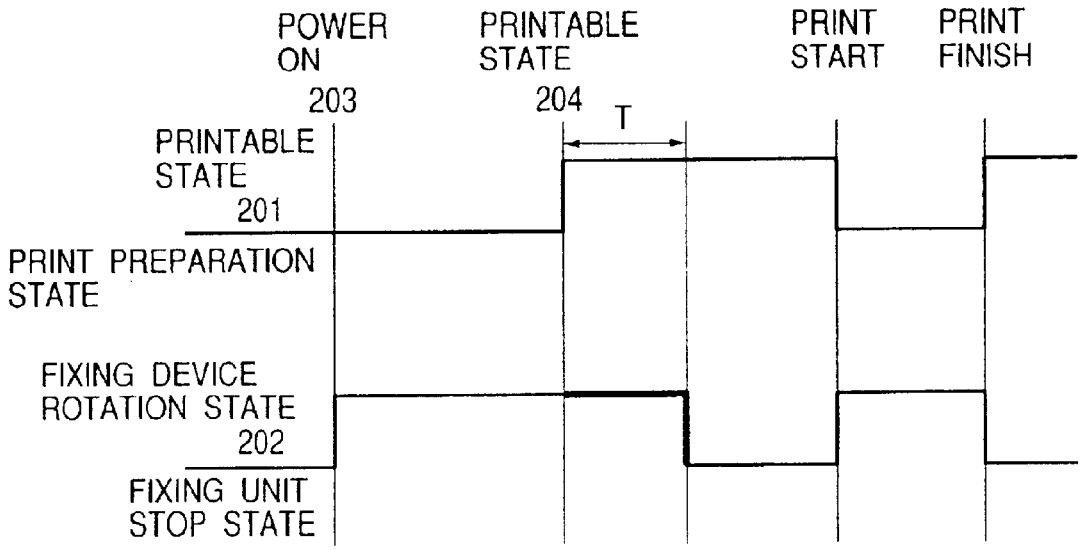
FIG. 12 PRIOR ART
FIG. 12 shows a time chart from the closing of the power switch of the image forming apparatus according to the example of the prior art till the finish of print.

As a second embodiment, a construction in which by an induction heating process, heat is generated in a fixing roller which is a fixing rotary member is shown in FIG. 10.

The reference numeral 2001 designates a fixing roller as a fixing rotary member, and the reference numeral 2002 denotes a pressure roller as a pressure rotary member. The fixing roller 2001 is formed of an electrically conductive material generating heat by an induction current, and in the present embodiment, it has as a base body a mandrel cylinder (electrically conductive cylindrical roller) made of iron and having an outer diameter of 40 mm and a thickness of 0.7 mm, and may be provided, for example, with a surface mold releasing layer of PTFE or PFA having a thickness of 10 to 50 μm in order to enhance the mold releasing property of the surface thereof. Also, in order to improve the fixing property and reduce the unevenness of the surface temperature of the roller, for example, an elastic layer of 20 to 500 μm which is a silicone rubber layer may be provided between the iron mandrel cylinder and the surface mold releasing layer.

The pressure roller 2002 comprises a hollow mandrel 2011 and an elastic layer 2012 which is a surface mold releasable heat-resistant rubber layer formed on the outer peripheral surface thereof or a sponge layer serving also to insulate heat between the hollow mandrel 2011 and the surface. The fixing roller 2001 and the pressure roller 2002 have their respective opposite end portions rotatably mounted between fixing unit frames, not shown, through bearings in such relationship that the fixing roller 2001 overlies and the pressure roller 2002 underlies and the two rollers are parallel to each other. The pressure roller 2002 is upwardly biased toward the rotary shaft of the fixing roller 2001 by a pressing mechanism, not shown, using a spring or the like and is brought into pressure contact with the underside portion of the fixing roller 2001 with a predetermined pressure force to thereby form a fixing nip part N. In the present embodiment, the pressure roller 2002 is loaded with about 30 kgf, and in that case, the width (nip width) of the fixing nip part N is about 6 mm. Owing to circumstances, however, the load may be changed to thereby change the nip width.

In the present embodiment, design is made such that the fixing roller 2001 is rotatively driven by a driving mechanism, and with the rotative driving of this fixing roller 2001, the pressure roller 2002 is driven to rotate by a frictional force in the fixing nip part N. The reference numeral 2014 designates an induction coil assembly inserted and disposed in the internal space of the fixing roller 2001, and it comprises an induction coil 2003 as a coil, a coil holder 2005 as a supporting member for supporting the coil, a core (magnetic core) 2007, a stay 2006, etc. The coil holder 2005 is a pail-shaped member of a substantially semicircular cross-sectional shape formed of heat-resistant resin such as PPS, PEEK or phenol resin, and a lead wire is wound around this coil holder 2005 to thereby provide the induction coil 2003. The core 2007 is assembled inside the coil holder 2005 so as to have a T-shaped cross section. These are integrated as an induction coil assembly. This induction coil assembly 2014 is inserted into the internal space of the fixing roller 2001 and with the induction coil 2003 outside the coil holder 2005 facing down and brought close to the inner surface of the fixing roller 2001, the opposite end portions of the stay 2006 are fixedly supported between the fixing unit frames, not shown, whereby the induction coil assembly 2014 is disposed in the internal space of the fixing roller 2001. The reference numeral 2004 denotes a temperature sensor such as a contact type thermistor as a temperature detecting member disposed so as to contact with the surface of the fixing roller 2001, or an infrared ray type non-contact thermistor. The reference numeral 2010 designates a separating pawl disposed in contact with or in proximity to the surface of the fixing roller 2001 at the recording material exit of the fixing nip part N.

Thus, in a state in which the fixing roller 2001 is rotatively driven and the pressure roller 2002 is driven to rotate thereby, an alternating current of a high frequency is applied from an electric power supplying portion to the induction coil 2003. The electric power supplying portion is adapted to be capable of generating a high frequency of 10 kHz to 100 kHz by a switching power source. The induction coil 2003 produces an alternating magnetic flux by the alternating current of a high frequency supplied from this electric power supplying portion. The magnetic flux induced by the alternating current lets an eddy current flow to the inner surface of the fixing roller 2001 which is an electrically conducting layer and generates Joule's heat, and the fixing roller 2001 is efficiently and quickly heated and rises in temperature.

The temperature of this fixing roller 2001 is detected at each preset predetermined sample period by the temperature sensor 2004, and the detected temperature signal is inputted to a CPU. The CPU increases or decreases the electric power supply from the electric power supplying portion to the induction coil 2003 on the basis of the detected temperature signal to thereby automatically control the surface temperature of the fixing roller 2001 at any time so as to be maintained at a predetermined constant temperature (preset target temperature). In a state in which the surface temperature of the fixing roller 2001 is automatically controlled at the predetermined constant temperature, a recording material 401 is fed over guide 2008 into the fixing nip portion N and is nipped and conveyed thereby, whereby an unfixed toner image 2009 is heated and fixed on the recording material 401 by the heat of the fixing roller 2001. To increase the heat generation of the fixing roller, the number of turns of the induction coil can be increased, or a material of high permeability and low residual magnetic flux density such as ferrite or Permalloy can be used as the core, or the frequency of the alternating current can be made high. The induction coil 2003 used in the present embodiment is formed by winding a litz wire comprising twisted 50 to 150 strands by 6 turns. The number of turns can be, for example, 4 turns to 10 turns. Even such a heating method of generating heat in the fixing roller by an induction heating process can obtain an effect similar to that of the first embodiment by the present invention being applied thereto.

As described above, according to the present invention, in spite of the raising time being short, the faulty fixing due to the insufficient heat of the pressure roller after warmup can be prevented. Further, even in a construction wherein electric power used is limited and the rotary members of the fixing apparatus cannot be sufficiently warmed during warmup, it is possible to shorten the raising time and yet prevent the faulty fixing due to the insufficient heat of the pressure roller after warmup.

Further, by having finer stages of idle rotation time, a fixing property of high quality is realized, and by slowing down the idle rotation speed of the fixing roller, the quietude of the image forming apparatus is realized at the same time.

While the embodiments of the present invention has been described above, the present invention is in no way restricted to the above-described embodiments, but all modifications are possible within the technical idea of the present invention.

What is claimed is:

1. An image forming apparatus comprising:

image forming means for forming a toner image on a recording material;

a fixing rotary member and pressure rotary member forming a nip wherein the toner image on the recording material is fixed as the recording material passes through the nip;

heating means for heating said fixing rotary member;

means for performing a warming-up operation for increasing a temperature of said fixing rotary member to a predetermined temperature;

means for, subsequently to said warming-up operation, performing a heat accumulation operation for accumulating heat to said fixing rotary member and pressure rotary member while rotating said fixing rotary member and pressure rotary member; and changing means for changing a duration of said accumulation operation in accordance with a duration of said warming-up operation.

2. An image forming apparatus according to claim 1, wherein when the duration of said warming-up operation is long, the duration of said accumulation operation is made to be long.

3. An image forming apparatus according to claim 1 or 2, wherein said pressure rotary member has a mandrel and an elastic layer provided thereon.

4. An image forming apparatus according to claim 3, further comprising heating means, which is arranged in said mandrel, for heating said pressure rotary member.

5. An image forming apparatus according to claim 1, wherein a state capable of starting image forming is brought about in accordance with a termination of said warming-up operation.

6. An image forming apparatus according to claim 1, wherein said heating means is arranged in said fixing rotary member.

7. An image forming apparatus according to claim 1, wherein said heating means includes a halogen lamp.

8. An image forming apparatus according to claim 1, wherein said heating means includes magnetic flux generating means for heating said fixing rotary member by electromagnetic induction.

* * * * *

UNITED STATES PATENT AND TRADEMARK OFFICE

CERTIFICATE OF CORRECTION

PATENT NO. : 6,952,541 B2
DATED : October 4, 2005
INVENTOR(S) : Takashi Fujimori et al.

It is certified that error appears in the above-identified patent and that said Letters Patent is hereby corrected as shown below:

Column 1,
Line 16, “be” should be deleted.
Line 39, “length wisely” should read -- lengthwise --.
Line 43, “control” should read -- controls --.

Column 2,
Line 49, “raising” should read -- rising --.
Line 63, “continuedly” should read -- continuously --.

Column 5,
Line 43, “after all,” should be deleted.

Column 12,
Line 49, “has” should read -- have --.

Signed and Sealed this

Fourth Day of April, 2006

JON W. DUDAS
*Director of the United States Patent and Trademark Office*